US006056451A

United States Patent [19]

Seki et al.

[11] Patent Number: 6,056,451

[45] Date of Patent: May 2, 2000

[54] PHOTOGRAPHIC FILM PROCESSING APPARATUS

[75] Inventors: Kohji Seki; Yoshiyuki Yamaji, both of Wakayama, Japan

[73] Assignee: Noritsu Koko Co., Ltd., Wakayama-ken, Japan

[21] Appl. No.: 08/598,505

[22] Filed: Feb. 8, 1996

[30] Foreign Application Priority Data

| | | | |
|---|---|---|---|
| Feb. 8, 1995 | [JP] | Japan | 7-020376 |
| Aug. 29, 1995 | [JP] | Japan | 7-220318 |
| Dec. 5, 1995 | [JP] | Japan | 7-316629 |

[51] Int. Cl.[7] ..... G03D 13/00

[52] U.S. Cl. ..... 396/568; 83/365; 396/613; 396/615

[58] Field of Search ..... 354/297, 298, 354/317–321; 355/27–29, 40, 41, 77; 83/358, 364, 365, 261

[56] References Cited

U.S. PATENT DOCUMENTS

| | | | |
|---|---|---|---|
| 3,699,832 | 10/1972 | Smith et al. | 83/365 X |
| 4,319,946 | 3/1982 | Inoue | 156/350 |
| 4,935,809 | 6/1990 | Hayashi et al. | 358/76 |
| 5,029,313 | 7/1991 | Robison et al. | 355/40 |
| 5,032,707 | 7/1991 | Gudmundson et al. | 355/40 X |
| 5,281,993 | 1/1994 | Crochetierre et al. | 355/40 |
| 5,473,402 | 12/1995 | Long et al. | 354/298 |

FOREIGN PATENT DOCUMENTS

| | | | |
|---|---|---|---|
| 56-109349 | 8/1981 | Japan . | |
| 4-125554 | 4/1992 | Japan | 354/297 |

*Primary Examiner*—D. Rutledge
*Attorney, Agent, or Firm*—Felfe & Lynch

[57] ABSTRACT

A photographic film processing apparatus for processing long developed film (10*b*) formed by joining photographic films with a splicing material (13). The apparatus includes a first transport device (40*a*) for transporting the long developed film. A region of the splicing material in the long developed film is detected in order to cut the long film. A main cutter (60) cuts the long developed film transported by the first transport device, in the region of the splicing material into short films (10*a*) prior to an exposing process. A second transport device (40*b*) is provided for transporting the short films to exposure processing units (20, 30). Further, an auxiliary cutter (70) is provided for cutting lateral portions of the region of the splicing material in the long developed film. The region of the splicing material is cut such that a width of an upstream short film is contained within a width at a forward end of a downstream short film.

21 Claims, 10 Drawing Sheets

PHOTOGRAPHIC FILM PROCESSING APPARATUS

BACKGROUND OF THE INVENTION

1. Field of the Invention

The present invention relates to a photographic film processing apparatus for processing a long developed photographic film formed by joining a plurality of films with a splicing material.

2. Description of the Related Art

In processing exposed photographic film with a small automatic developing unit, films in respective clients' orders are developed separately, one after another.

However, it is inefficient to process one film after another. For processing with a large automatic developing unit, therefore, exposed photographic films in a plurality of orders are joined at the ends with a splicing material (e.g. splice tape) to form a long photographic film. The long photographic film is continuously developed and taken up in the form of a roll.

The developed photographic film taken up in a roll is subjected to a printing process by an automatic printing unit. In conventional practice, for example, the long film is passed through the printing process and taken up in a roll again, and subsequently the film is cut order by order by a cutting device.

Developed photographic film such as an ordinary 135 film, for example, may be a film with full-size or panorama-size frames 36 mm long each, or a film with half-size frames 17 mm long each.

No problem arises where the automatic printing unit can cope with all sizes at high speed. However, the full size and panorama size require different size pieces of printing paper and different degrees of enlargement. In the case of half size, the direction of printing paper is variable between longitudinal and transverse, besides a different degree of enlargement. Thus, in practice, there are limitations to what the automatic printing unit can do.

Conventionally, where a long photographic film includes panorama-size and half-size films, the long film is subjected to a printing process and taken up in a roll, while printing only the full-size film first, skipping the panorama-size and half-size films. Subsequently, the panorama-size and half-size films are printed, and the long film is cut for respective orders. Where film in one order has a mixture of full-size and panorama-size films, similarly the full-size film is printed first, and then the panorama-size film, followed by a cutting process.

Thus, varied image lengths may be present in a long photographic film formed by joining a plurality of films with a splicing material. This gives rise to a problem, with the conventional apparatus, of requiring very complicated and inefficient processes from printing to cutting.

SUMMARY OF THE INVENTION

In order to solve the problem encountered in the prior art noted above, the object of the present invention is to provide a photographic film processing apparatus for carrying out various exposing processes including a printing process efficiently and speedily even for a long developed photographic film formed by joining a plurality of films with a splicing material.

The above object is fulfilled, according to the present invention, by a photographic film processing apparatus comprising:

a first transport device for transporting a long developed film formed by joining photographic films with a splicing material;

a joint detecting device for detecting a region of the splicing material in the long developed film;

a main cutter for cutting the long developed film transported by the first transport device, in the region of the splicing material to form short films; and a second transport device for transporting the short films to exposure processing units.

That is, the main cutter cuts the long developed film into short films prior to an exposing process, and the second transport device transports the short films to the exposure processing units.

With the above construction, the long film is cut into short films corresponding to respective orders from clients. These short films are transported to the exposure processing units.

After the long film is cut into short films corresponding to the respective orders, the short films having special image frames such as panorama-size or half-size frames are excluded once before reaching the exposure processing units. Those short films having only full-size image frames are transported to the exposure processing units. Alternatively, an appropriate measure may be taken to omit an exposing process for the short films having special size image frames. This apparatus avoids the complicated practice of the prior art. That is, in the prior art, films in a long spliced film having only full-size image frames are processed by the exposure processing units and the long film is taken up in a roll. Then films having special size frames are processed by the exposure processing units. Thereafter the long film is cut order by order. Thus, the apparatus according to the present invention carries out various exposing processes efficiently as a whole.

Where the exposure processing units can cope with the full size and panorama size of the same image frame length, only half-size films having a different image frame length may be excluded. Where the exposure processing units can cope with full size and half size, only the panorama size films may be excluded.

Apart from the presence of special size films, the long photographic film could include films unfit for an exposing process because of an extreme degree of over-exposure or under-exposure. An appropriate measure may be taken to exclude such films.

In a preferred embodiment of the present invention, a loop storing device is disposed on a transport line formed by the first transport device and the second transport device for storing the long developed film in loop form. This construction enables a smooth operation by absorbing or eliminating any time lag between the process of cutting the long photographic film by the main cutter and the processes by the exposure processing units.

In another embodiment of the invention, a discharge device is interposed between the main cutter and the exposure processing units for discharging film fragments cut by the main cutter from a transport line formed by the first transport device and the second transport device. With this construction, film fragments resulting from the cutting process may automatically be discharged from the film transport line. Consequently, the film transport is not affected by cut, unwanted parts of the film.

In a further embodiment of the invention, a film propriety distinguishing device is disposed on a transport line formed by the first transport device and the second transport device for determining whether the short films are fit for processing by the exposure processing units. The film propriety distinguishing device distinguishes, without requiring observation by the operator, image frames of special lengths mixed into the long developed photographic film or presence of films having overexposed image frames, for example. This automatic distinguishing operation realizes improved efficiency and reliable results of distinguishment.

The processing apparatus may further comprise a process averting device for averting, from processing by the exposure processing units, those of the short films determined by the film propriety distinguishing device to be unfit. Preferably, the process averting device defines a branch line for branching the short films determined to be unfit from the transport line. A simple additional construction consisting of the branch line enables an automatic removal of unfit photographic films before reaching the exposure processing units, to smooth the processing by the exposure processing units.

Preferably, the discharge device defines a discharge passage extending downward from the transport line for guiding cut film fragments including small fragments from film regions adjacent the splicing material and a large fragment including a film leader connected to a forward end of the long developed film, the discharge passage including a partition mounted in an intermediate position thereof for allowing passage of only the small fragments and deflecting the large fragment. Thus, large and small film fragments all fall into the discharge passage, and the large fragment including the leader is deflected by the partition. Generally, the leader is larger than the fragments cut from the region of the splicing material in the photographic film. Utilizing this fact, the leader may be collected separately from the fragments cut from the splice region of the photographic film by the simple construction consisting of the partition disposed in an intermediate position of the discharge passage.

Further, the partition may be disposed in such a position that the large fragment is transported by the transport line until a forward end of the film leader reaches the partition. Then, the leader advancing through the discharge passage is controlled with respect to position and inclination transversely of the advancing direction. Thus, the leader is restrained from shifting or inclining to varied extents transversely of the advancing direction, thereby to realize reliable sorting of the leader.

The invention proposes that the discharge device includes a branching opening defined in a side wall of the discharge passage above the partition for allowing passage of the large fragment. This opening is provided in order to separate the leader positionally and clearly from the small fragments which are to be discarded, so that the leader may be recovered, with priority, for reuse.

To remove the cut fragments with greater assurance, the discharge device may include a movable guide disposed in a region of intersection between the transport line and the discharge passage to be switchable between a posture for guiding the short films to advance along the transport line and a posture for guiding the film fragments cut by the main cutter into the discharge passage.

To ensure that the region of the splicing material does not adversely affect the film transport when the short films are transported and processed at the same time, the processing apparatus in a preferred embodiment further comprises an auxiliary cutter for cutting lateral portions of the region of the splicing material in the long developed film.

According to this construction, when the main cutter is operated to cut the long photographic film in the region of the splicing material to a short film corresponding to each order, for example, the auxiliary cutter may also be operated to cut lateral portions of the region of the splicing material. Consequently, any portions of the film protruding laterally of the region of the splicing material may be removed as otherwise such portions could obstruct a subsequent transporting process.

When the main cutter cuts the long photographic film in the region of the splicing material, the following cutting positions are conceivable:

(1) Cutting in such a position that at least part of the splicing material remains attached to one of the short films downstream with respect to a direction of transport;

(2) Cutting in a position upstream of the splicing material with respect to the direction of transport; and (3) Cutting only in a position upstream of the splicing material whereby the splicing material remains intact on the downstream one of the short films.

In all of the above cutting modes, at least part of the splicing material remains attached to the downstream short film. In a preferred embodiment of the invention, the splicing material remaining attached to one of the short films includes data relating to that short film to facilitate subsequent film processing. For this purpose, a reading device may be mounted on the transport line for reading the data from the splicing material and outputting contents of the data. It is particularly advantageous if the data is stored in a film identifying bar code printed on the splicing material.

Preferably, the auxiliary cutter is operable to cut the region of the splicing material such that a width at a forward end of an upstream one of the short films is contained within a width of the downstream one of the short films. With this construction, the forward end of the upstream film is completely contained within the width at the rear end of the downstream film. Consequently, the forward end of the upstream film remaining connected to the splicing material after cutting the long film is positively prevented from obstructing the transport.

In a preferred embodiment of the invention the main cutter and the auxiliary cutter are integrated. Then, the two cutters may share components and controls to reduce cost. This provides a further advantage of requiring reduced space.

Conversely, the auxiliary cutter may be formed separately from the main cutter. This allows the auxiliary cutter to be added to an existing apparatus or to be offered as an option.

Other features and advantages of the invention will be apparent from the following description of a preferred embodiment of the invention, as illustrated in the accompanying drawings.

DETAILED DESCRIPTION OF THE PREFERRED EMBODIMENTS

A photographic film processing apparatus according to the present invention will be described with reference to the drawings.

Figure 1:
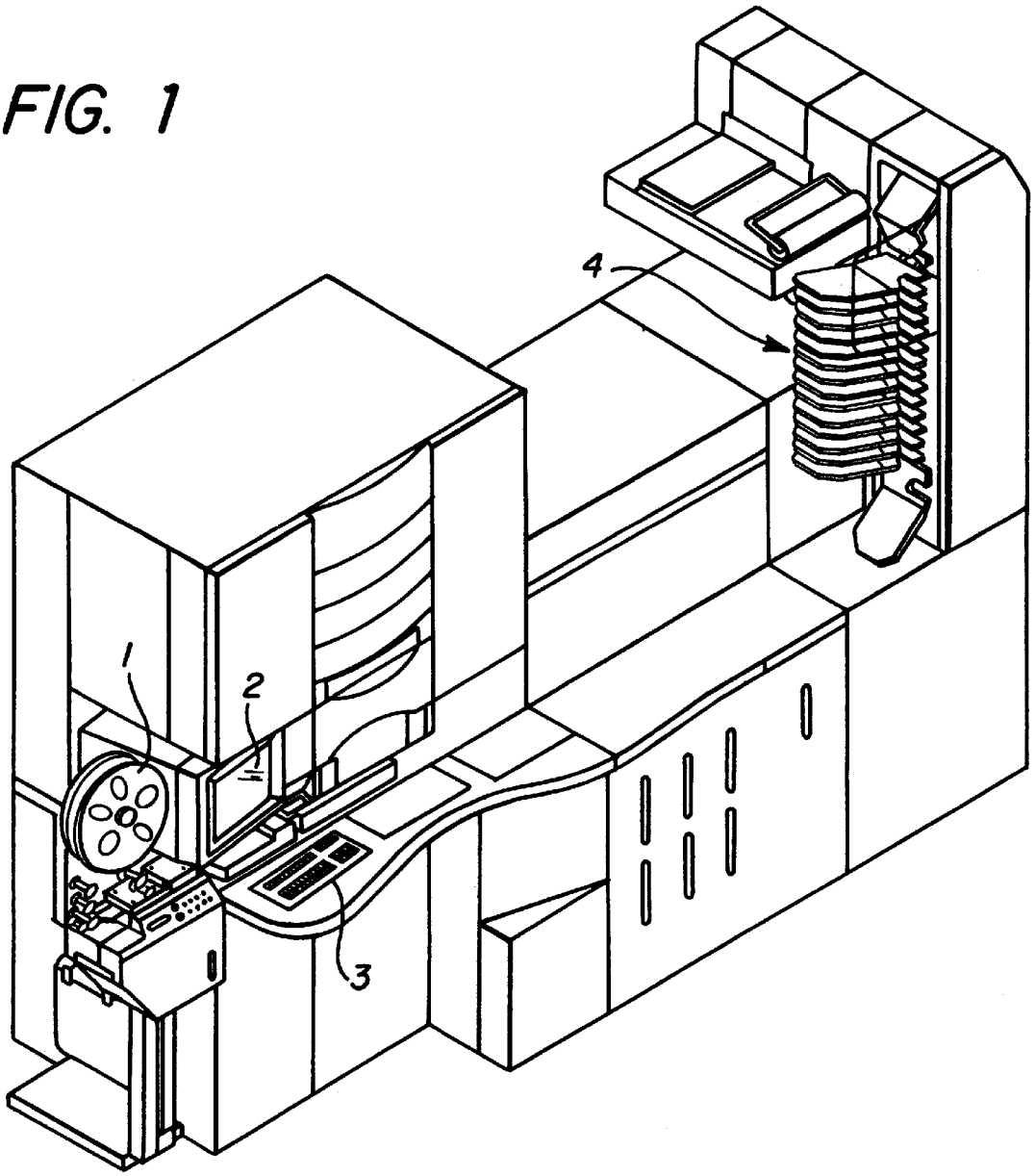
FIG. 1 is a perspective view an automatic exposing and printing apparatus according to the present invention.

FIG. 1 shows an automatic exposing and printing apparatus to which the photographic film processing apparatus according to the present invention is applied. The exposing and printing apparatus contains an image information reading unit 20 and an exposing and printing unit 30 which will be described later. Image information on developed negative film 10 wound on a reel 1 is read by the reading unit 20 and shown on a display 2. Based on the information shown, the operator operates a keyboard 3 to cause the exposing and printing unit 30 to expose printing paper in a proper amount of exposure. After a subsequent printing process, finished prints are discharged to a print collector 4.

Figure 2:
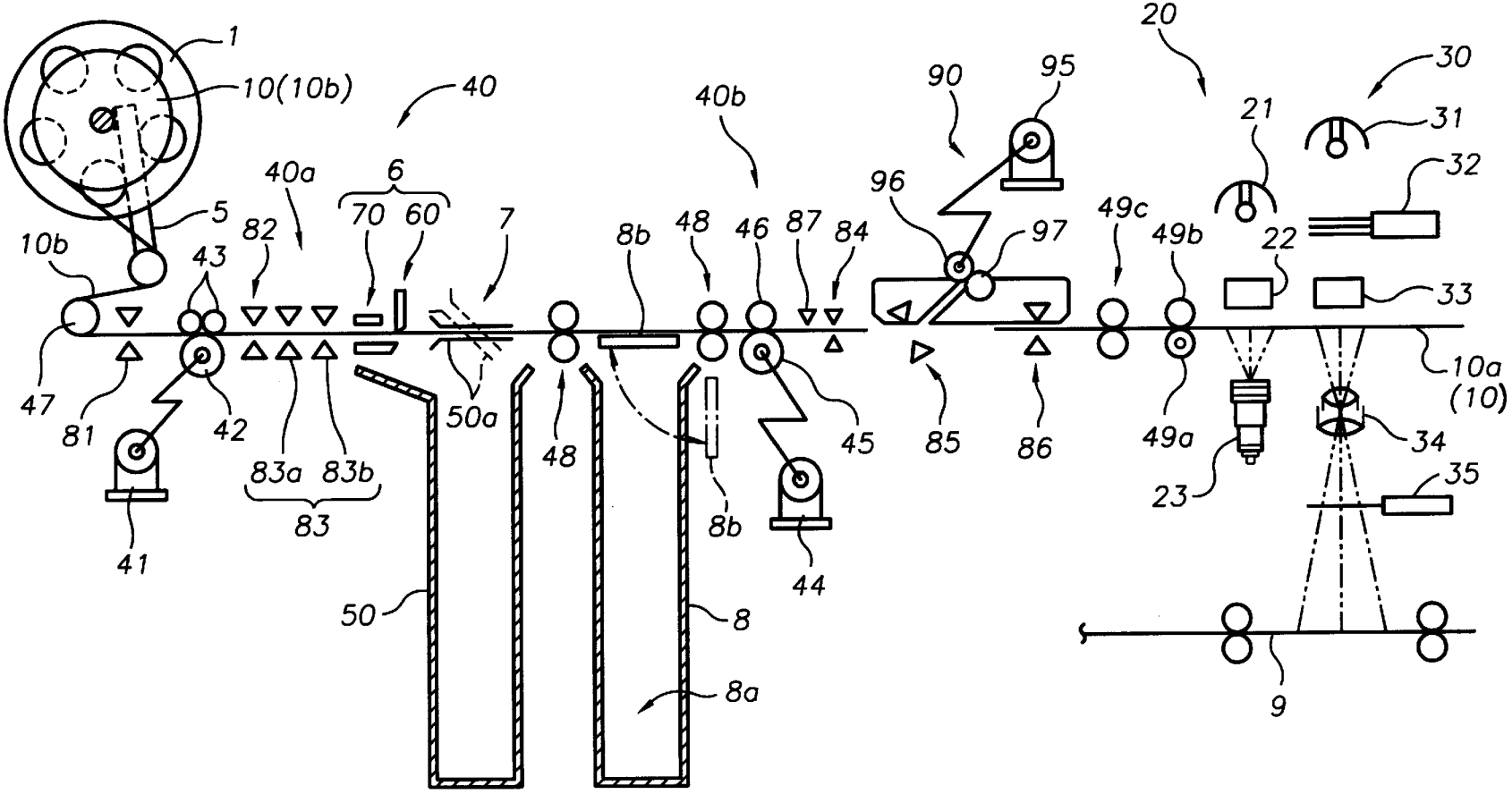
FIG. 2 is a schematic view showing a principal portion of the automatic exposing and printing apparatus.
Figure 3:
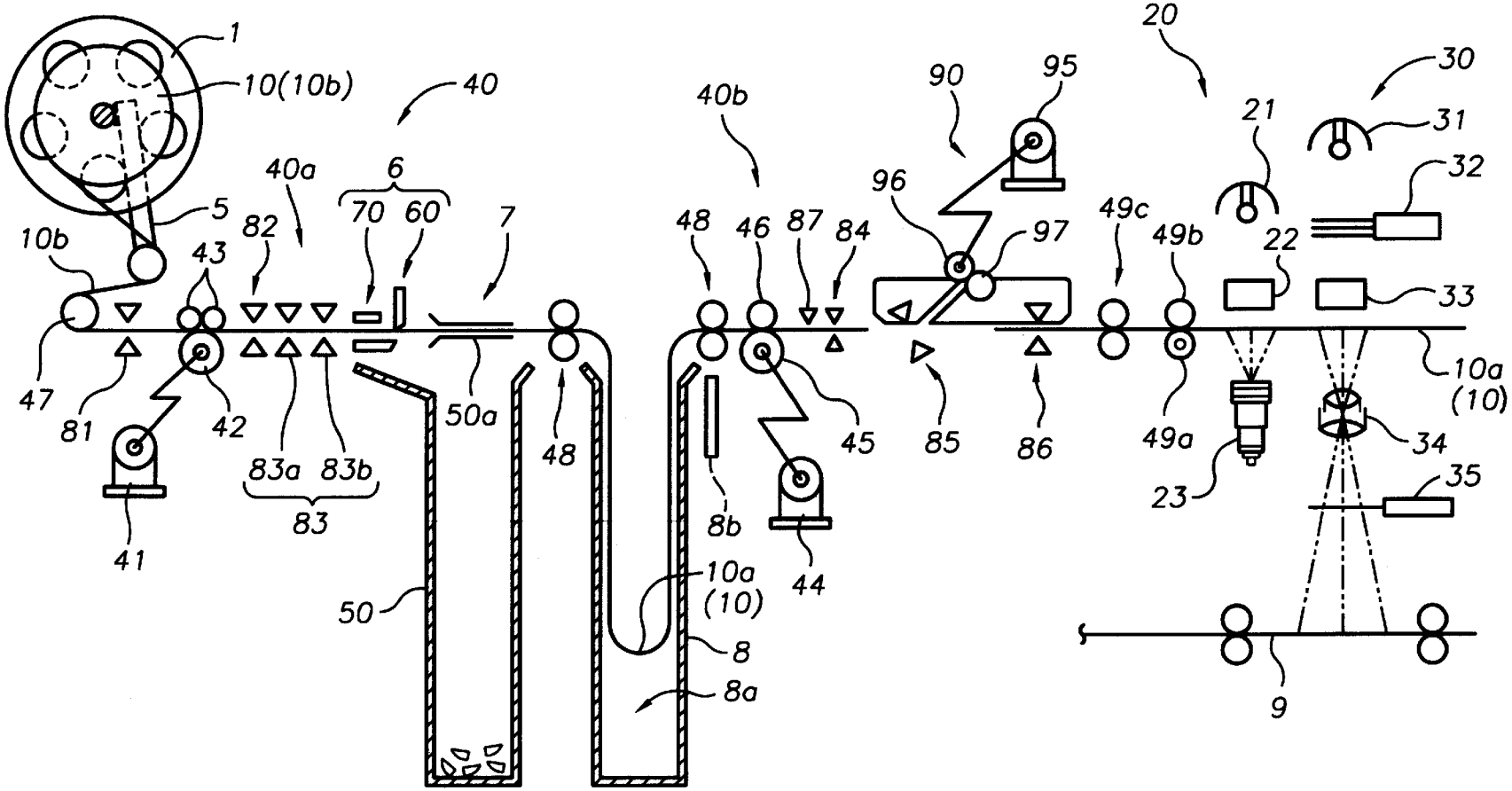
FIG. 3 is a schematic view showing the same principal portion of the automatic exposing and printing apparatus.
Figure 4:
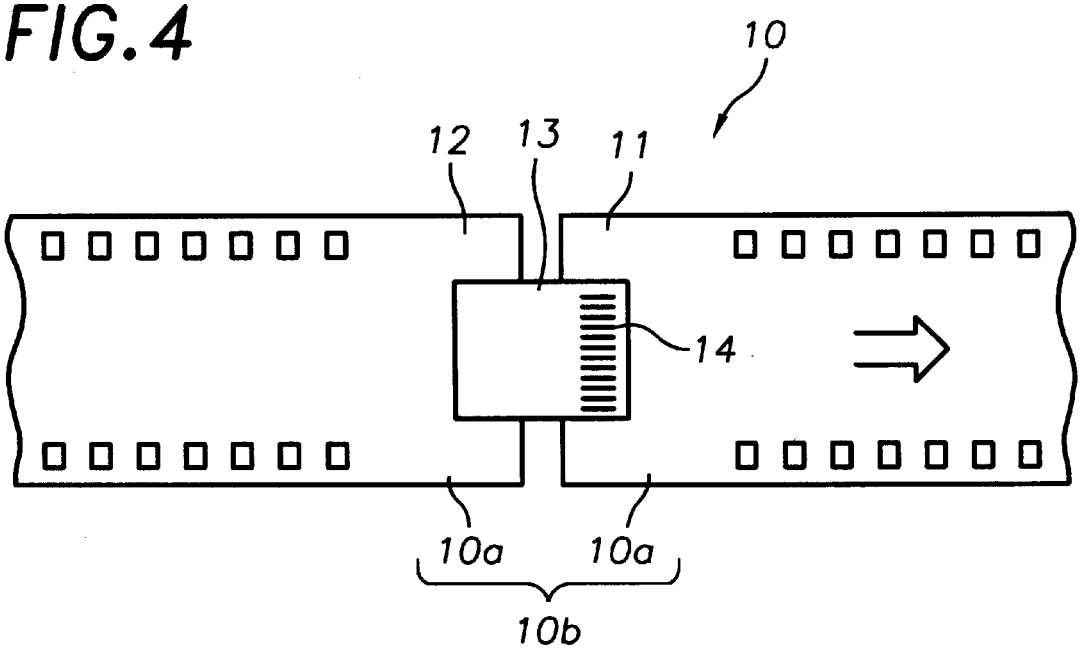
FIG. 4 is a schematic view of photographic films joined with splicing tape.
Figure 5:
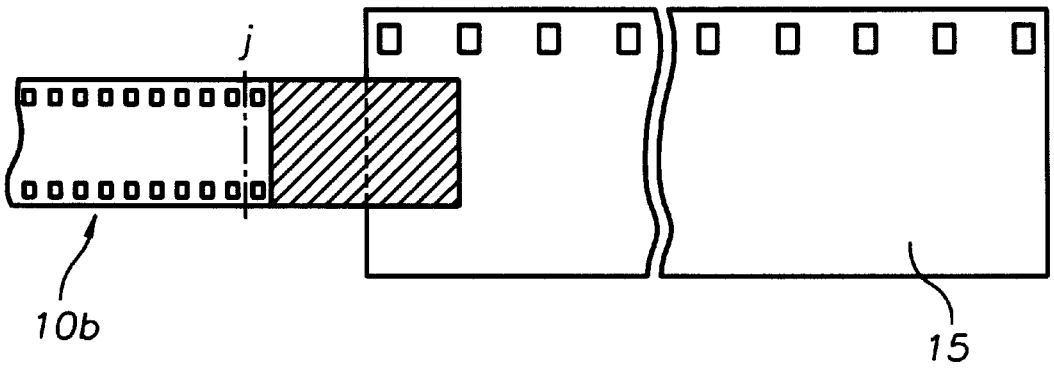
FIG. 5 is a schematic view of a leader region of a long film.

As shown in FIGS. 2 and 3, the reel 1 has, wound thereon, developed photographic film 10 in a plurality of orders from clients. The term "film 10" as used in this specification has two meanings. One meaning is short developed photographic films 10*a* included in the orders from clients. The other meaning is a long photographic film 10*b* formed by successively connecting the rear end 11 of each short developed film 10*a* in one order to the forward end 12 of another short developed film 10*a* with a splicing tape 13 which is one example of joining materials (see FIG. 4). The long film 10*b* may be cut order by order again prior to an exposing and printing process, as necessary. The short films made by cutting the long film 10*b* are also referred to herein as short films 10*a*. As shown in FIG. 5, the long film 10*b* has a leader 15, which itself is well known, connected to the forward end thereof.

A dancer 5 is disposed adjacent a support axis of the reel 1 for eliminating a slack of photographic film 10. A film transport device 40 extends from the reel 1 toward the image information reading unit 20 and exposing and printing unit 30, which are examples of exposure processing units, for transporting the photographic film 10, more particularly the long film 10*b*, wound on the reel 1.

The film transport device 40 includes a first transport portion 40*a* and a second transport portion 40*b*. The first transport portion 40*a* includes a first drive roller 42 driven by a pulse motor 41, two idle rollers 43 in contact with the first drive roller 42, a second drive roller 45 driven by a DC motor 44, an idle roller 46 in contact with the second drive roller 45, a direction changing idle roller 47, and a pair of idle roller 48 in contact with each other, for transporting the photographic film 10 toward the image information reading unit 20.

A film cutting device 6 described in detail later is disposed on the transport line of the first transport portion 40*a*. The film cutting device 6 cuts the long film 10*b* into short films 10*a* each corresponding to one order, and cuts off part of the film. The second transport portion 40*b* of the transport device 40 transports the short films 10*a* from the film cutting device 6 to the image information reading unit 20. The second transport portion 40*b* includes a third drive roller 49*a*, an idle roller 49*b*, and a pair of idle rollers 49*c*.

A plurality of sensors are arranged along the transport line of the transport device 40. These sensors include, for example, a film sensor 81 disposed upstream of the first drive roller 42 for detecting the photographic film 10, and an end sensor 82 disposed downstream of the first drive roller 42 for detecting splice regions of the photographic film 10 joined with the splicing tape 13, i.e. for detecting rear ends 11, forward ends 12 or splicing tapes 13. Each of these sensors 81 and 82 is formed of a light emitter and a light receiver.

Downstream of the end sensor 82 and upstream of the film cutting device 6 is an image frame distinguishing device 83 which is one example of film propriety distinguishing devices for determining whether or not the photographic film 10 in each order is fit for processing by the exposing and printing unit 30. The image frame distinguishing device 83 includes two image frame sensors 83*a* and 83*b* each formed of a light emitter and a light receiver, for detecting image frames on the photographic film 10 based on the quantities of light received after being transmitted through the film 10, and determining lengths of the respective image frames on the film 10. Specifically, the image frame distinguishing device 83, based on frame edge detection signals, measures longitudinal and transverse dimensions of the image frames in each order to determine whether the image frames are full size, panorama size or half size.

A discharge device 7 is disposed downstream of the film cutting device 6 for removing film portions adjacent the leader 15 and splicing tapes 13 cut by the cutting device 6 from the transport line.

Figure 6:
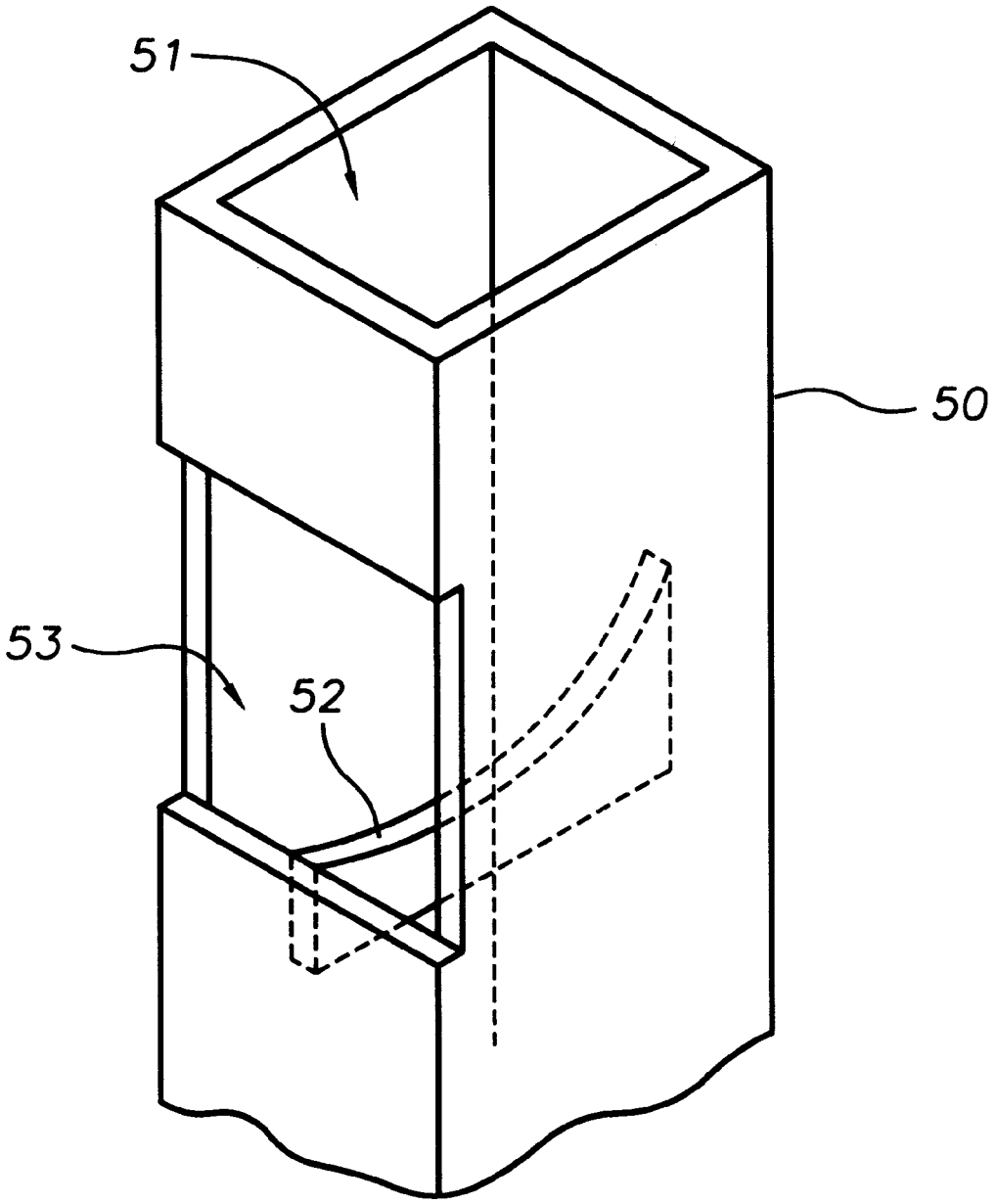
FIG. 6 is a perspective view of a lower portion of a trash box.

The discharge device 7 includes a trash box 50 disposed below the transport line, a pivotable guide 50*a* defining a slit for allowing passage of the film, and a solenoid, not shown, for driving the guide 50*a*. The guide 50*a* is movable between a posture extending along the transport line, as shown in solid lines in FIG. 2, for guiding the film 10, and a posture crossing the transport line, as shown in phantom lines, for guiding cut film fragments into the trash box 50. As shown in FIG. 6, the trash box 50 substantially is a rectangular parallelepiped with an open top. Thus, a discharge passage 51 of rectangular cross section is formed below the transport line. The discharge passage 51 has a width, as seen in the moving direction of the leader 15, corresponding to or slightly larger than the width of the leader 15, so that the leader 15 in descent may remain substantially in the same posture.

The leader 15 shown in FIG. 5 has a larger width than the film 10. The above is applicable also where a leader having the same width as the film 10 is used.

A partition 52 is formed in an intermediate position of the discharge passage 51 for allowing passage of small fragments of the film 10 cut from adjacent the splicing tapes 13 but prohibiting passage of the leader 15.

The partition 52 is in the form of a plate extending parallel to the film transport line and mounted in vertical posture right under a transversely middle position of the transport line. As shown in FIG. 6, the partition 52 defines a downwardly curved upper edge for contacting the leader 15. The curved edge has a lowermost point disposed adjacent an opening 53 described hereunder, to guide the leader 15 smoothly.

The opening 53 is formed directly above the partition 52 for passing the leader 15.

The trash box 50 is vertically divided into two parts in a position slightly above the opening 53, the lower part being detachably attached to the upper part. This construction facilitates disposal of the film fragments collected in the lower part.

A loop tank 8 is disposed downstream of the discharge device 7. The loop tank 8 defines a loop storing space 8*a* for storing the photographic film 10 in loop form. An open/close loop guide 8*b* is disposed in an opening of the loop tank 8, which is driven by a DC motor not shown.

Downstream of the loop tank 8 and second drive roller 45 is a forward end sensor 84 including a light emitter and a light receiver for detecting the forward end of the photographic film 10. Downstream of the forward end sensor 84 is a transport line branching device 90 acting as a process averting device for passing, without being processed by the image information reading unit 20 and exposing and printing unit 30, photographic film 10 in each order determined unfit by the image frame distinguishing device 83.

Figure 7A:
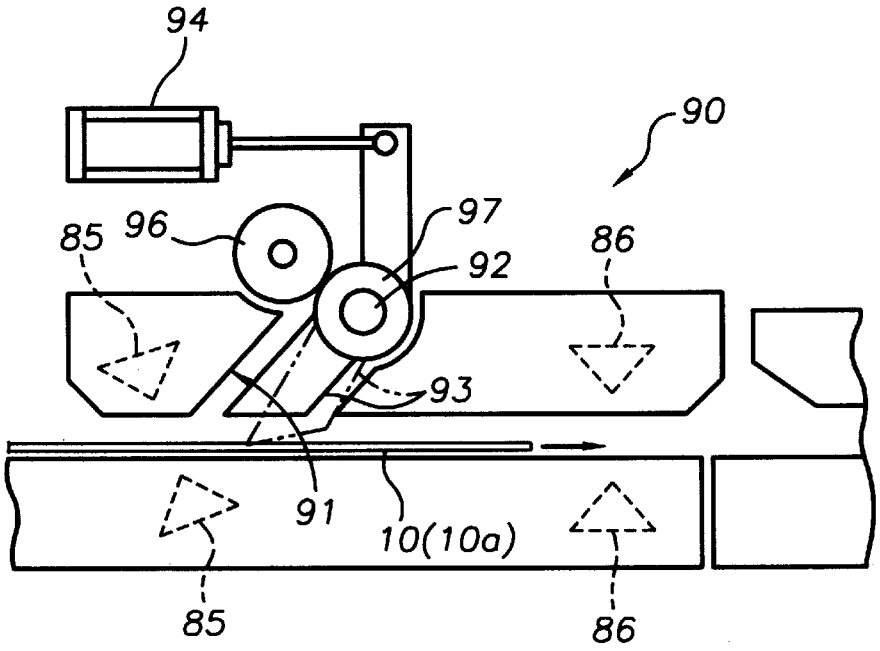
FIGS. 7A and 7B are schematic views showing details of a transport line branching device.
Figure 7B:
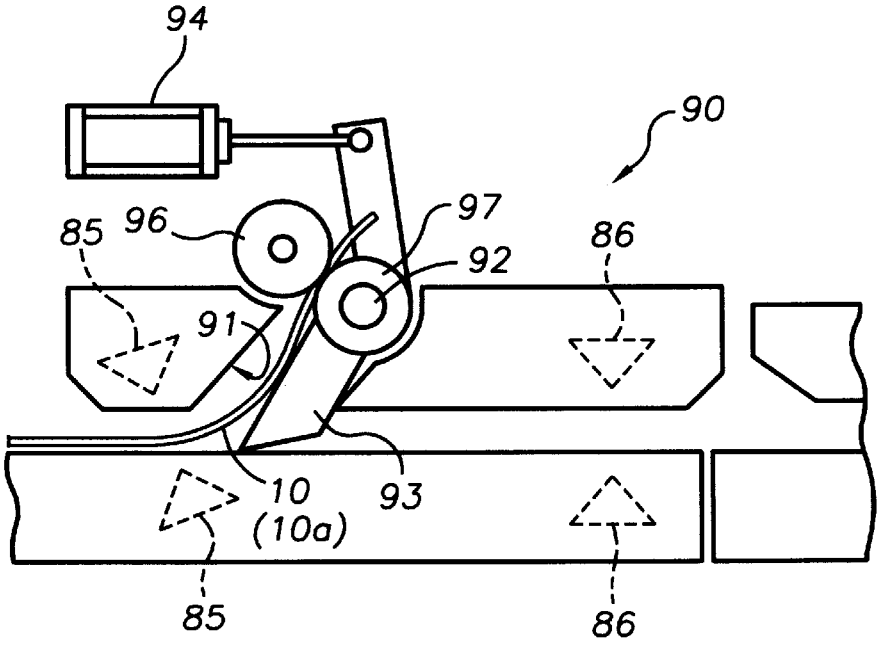

The transport line branching device 90 branches the photographic film 10 in each order determined unfit, off the second transport portion 40*a* of the transport device 40. As shown in detail in FIGS. 7A and 7B, the branching device 90 includes a through passage 91 acting as a branch line extending obliquely upward through a frame disposed on the transport line of the transport device 40, a line switching element 93 pivotably attached to an axis 92 inside the through passage 91, and a solenoid 94 for driving the line switching element 93. A fourth drive roller 96 driven by a DC motor 95 is disposed adjacent a terminal end of the through passage 91. The axis 92 supports an idle roller 97 in contact with the fourth drive roller 96. Thus, the photographic film 10 entering the through passage 91 is forcibly transported. A first rear end sensor 85 and a second rear end sensor 86 are arranged along the transport line of the transport device 40 upstream and downstream of the through passage 91, respectively, for detecting the rear end of the photographic film 10.

The image information reading unit 20 and exposing and printing unit 30 are arranged in the stated order downstream of the transport line branching device 90. The image information reading unit 20 and exposing and printing unit 30 both have known constructions. The image information reading unit 20 includes a lamp 21, a mirror barrel 22 and an image pickup 23. The exposing and printing unit 30 includes an exposure lamp 31, adjusting filters 32, a mirror barrel 33, optics 34 and a shutter 35 for enlarging and printing the images of the photographic film 10 on printing paper 9.

Figure 8A:
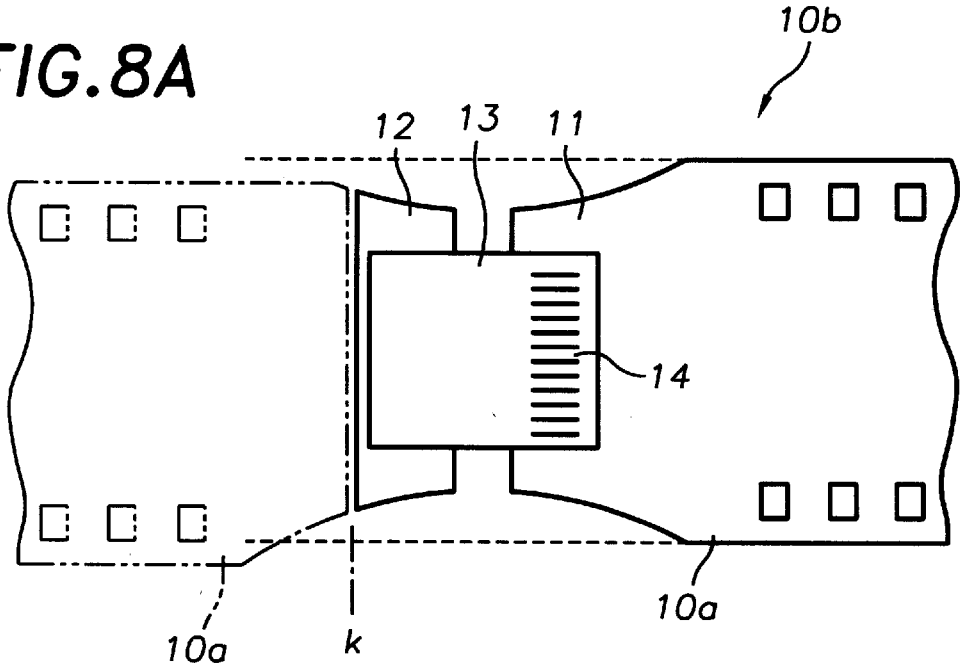
FIGS. 8A and 8B are schematic views showing a shape to which photographic films are cut by a cutting device.
Figure 8B:
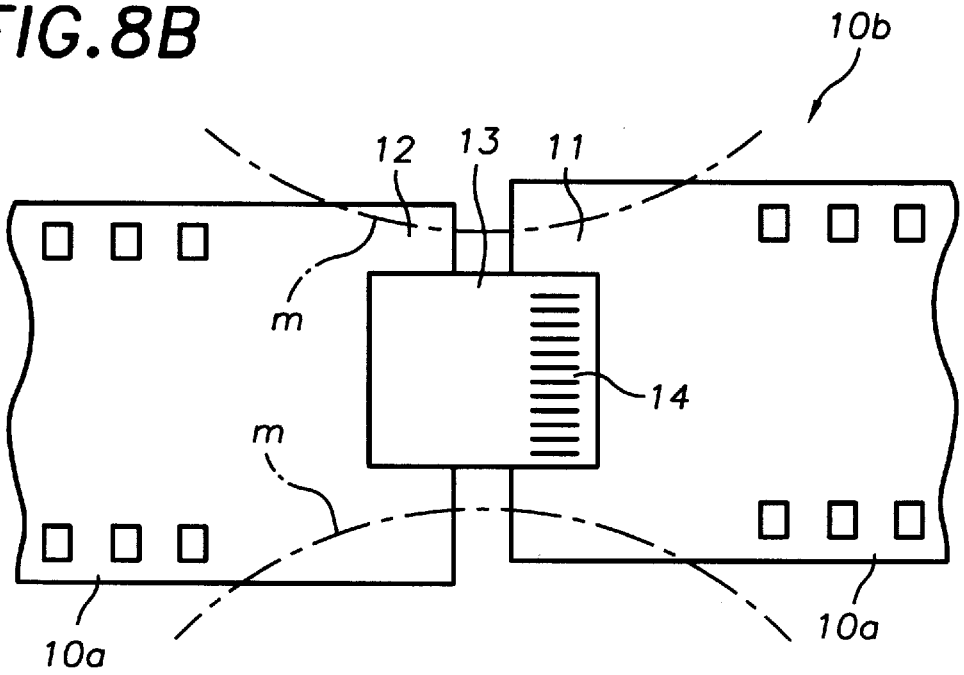

The film cutting device 6 includes a main cutter 60 and an auxiliary cutter 70. The main cutter 60 cuts the long film 10*b* along a transverse cutting line "k", as shown in FIG. 8A, at the forward end of each succeeding short film 10*a*, so that the splicing tape 13 remains on the rear end 11 of the preceding short film 10*a*. The auxiliary cutter 70 cuts, along arcuate cutting lines "m" as shown in FIG. 8B, the rear end 11 of the preceding film 10*a* and the forward end 12 of the succeeding film 10*a* at opposite lateral regions across the splicing tape 13. An order in which the main cutter 60 and auxiliary cutter 70 are operated to cut the long film 10*b* may be determined according to limitations such as an arrangement of the cutters. The present invention is not limited to a particular order. However, in the example shown in FIGS. 8A and 8B, the auxiliary cutter 70 is operated first to cut off the opposite sides of the film, and then the main cutter 60 is operated to cut transversely of the film.

Figure 9:
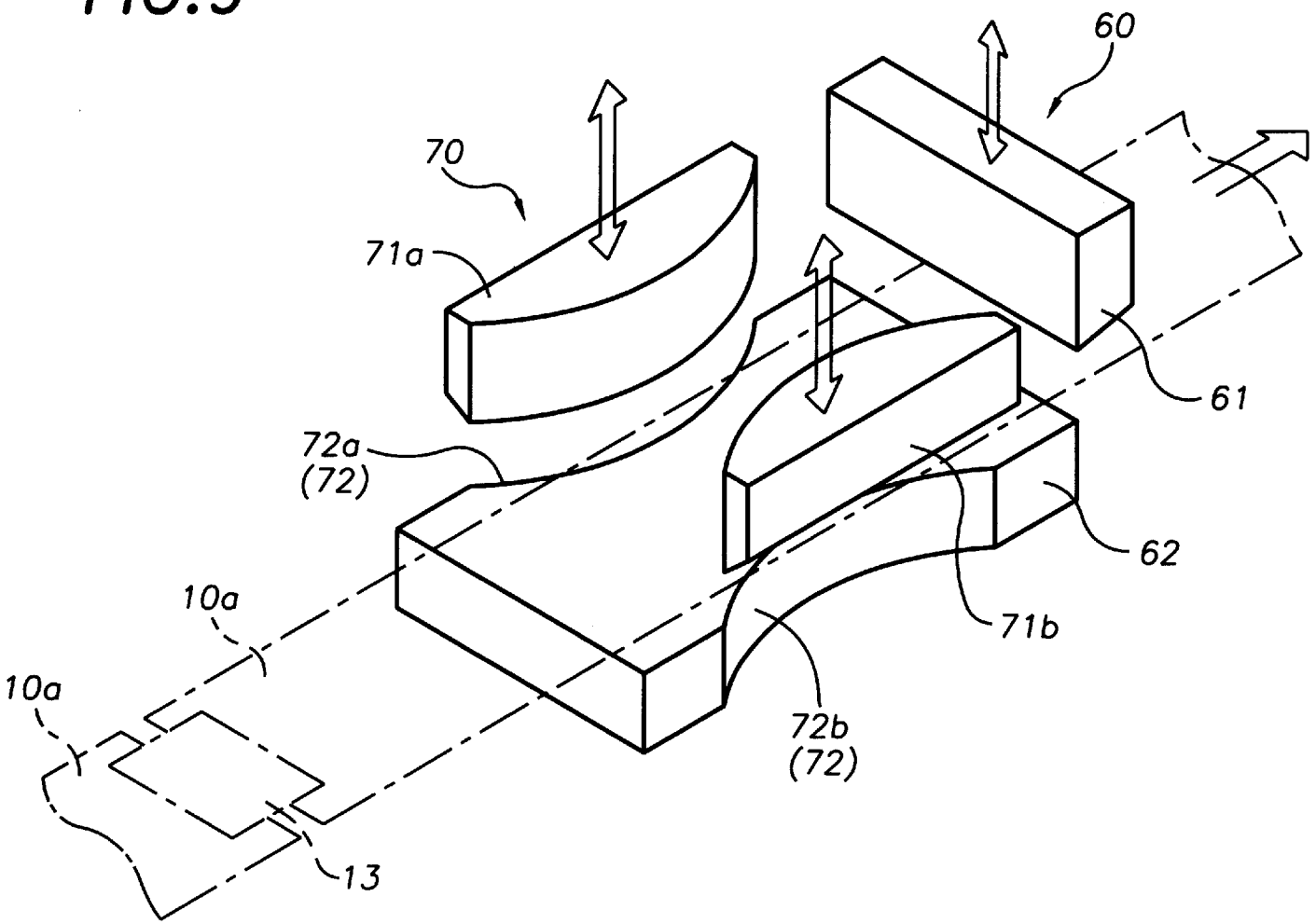
FIG. 9 is a schematic view of a main cutter and an auxiliary cutter.

As schematically shown in FIG. 9, the main cutter 60 includes a vertically movable upper blade 61 extending across the film transport line, and a lower blade 62 fixed on the transport line. When the upper blade 61 is lowered to the lower blade 62, the film is cut at the cutting line "k" shown in FIG. 8A. Further, the leader 15 is cut off at cutting line "j" shown in FIG. 5. The auxiliary cutter 70 includes a pair of vertically movable upper blades 71*a* and 71*b* arranged at opposite sides of the film transport line, and a pair of right and left lower blades 72*a* and 72*b* fixed on the transport line. When the upper blades 71*a* and 71*b* are lowered to the lower blades 72*a* and 72*b*, respectively, the opposite sides of the film are cut arcuately at the cutting lines "m" shown in FIG. 8B. As shown in FIG. 8A, the short films 10*a* may be interconnected such that the rear end 11 of the preceding film 10*a* and the forward end 12 of the succeeding film 10*a* are staggered sideways (a maximum amount of displacement may be guessed from experience). The arcuate cuts noted above are made to such an extent that the width of the forward end 12 remaining attached to the splicing tape 13 after the cutting operations of the main cutter 60 and auxiliary cutter 70 is contained within the width of the preceding film 10*a*.

Figure 10A:
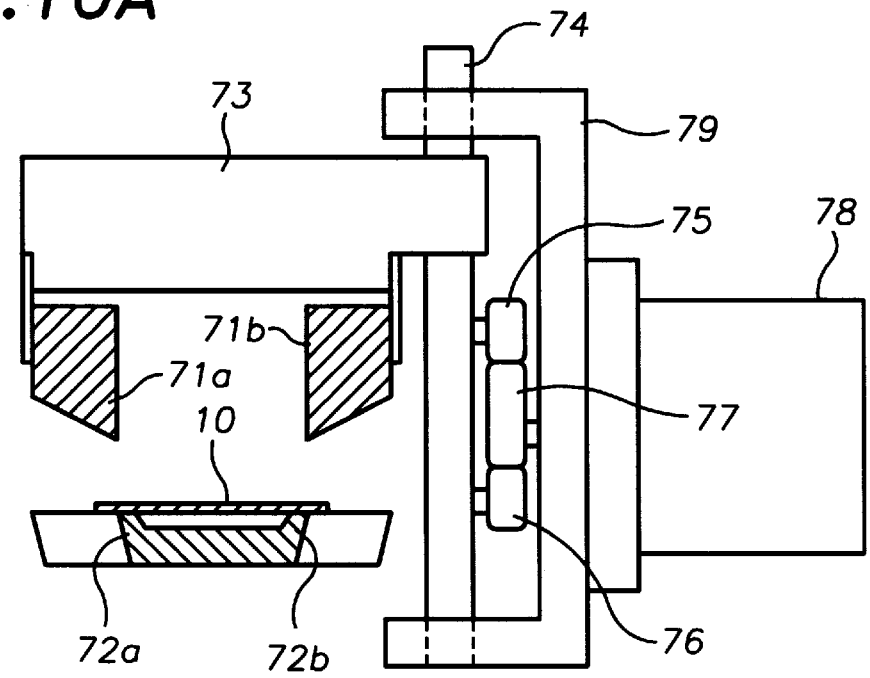
FIGS. 10A and 10B are schematic views of the auxiliary cutter.
Figure 10B:
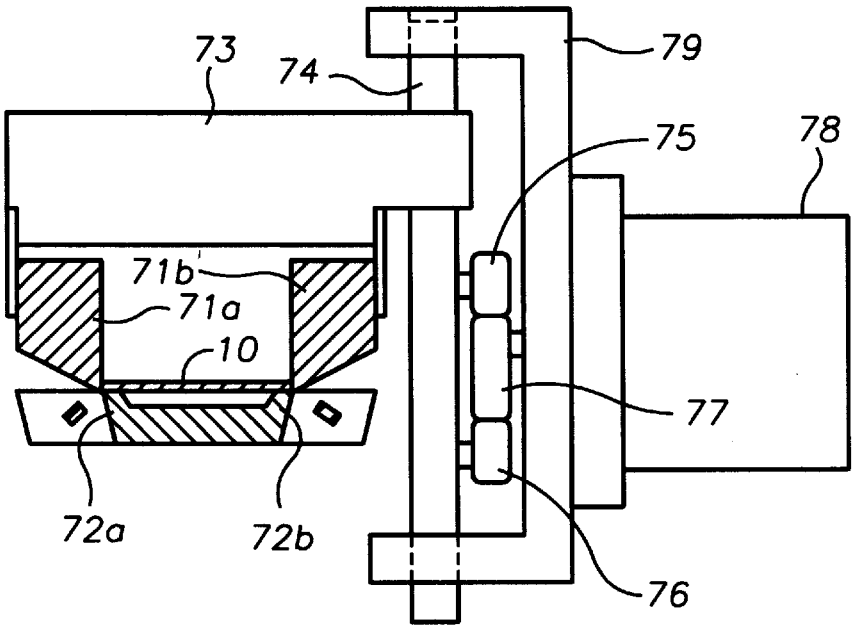

The auxiliary cutter 70 has a specific construction as shown in FIGS. 10A and 10B. The upper blades 71*a* and 71*b* are secured to a lift block 73 fixed to a lift pin 74. The lift pin 74 has an upper cam follower 75 and a lower cam follower 76 spaced from each other. An eccentric cam 77 is disposed in a space between the upper cam follower 75 and lower cam follower 76 to be rotatable by a motor 78. A frame 79 is provided for supporting the lift block 73 and guiding the lift pin 74. The eccentric cam 77 in rotation contacts the upper cam follower 75 and or the lower cam follower 76 to raise the lift pin 74, and thus the upper blades 71*a* and 71*b*. With a further rotation of the eccentric cam 77, the lift pin 74 is lowered and so are the upper blades 71*a* and 71*b*. By suitably selecting a shape of the eccentric cam 77, one rotation of the motor 78 produces a vertically reciprocating motion of the upper blades 71*a* and 71*b*. Such a raising and lowering mechanism is known in the art and will not particularly be described herein.

The main cutter 60 has substantially the same construction as the auxiliary cutter 70, and will not be described. Naturally, other types of raising and lowering mechanism may be employed, and the present invention is not limited to a particular type.

Where the main cutter 60 and auxiliary cutter 70 are integrated, the lower blades 62 and 72 may be formed together, and the shape of the eccentric cam may be devised to share the motor 78. Such integration will contribute to reduced cost.

As shown in FIG. 8A, the splicing tape 13 is allowed to remain on each preceding short film 10*a* when the cutting device 6 is operated to cut the long film 10*b* into short films 10*a* for respective orders. The splicing tape 13 includes ID information, preferably in the form of a bar code 14, printed thereon for identifying the preceding film 10*a*. The splicing tape 13 is retained in order to use this information in subsequent processing of this film 10*a*.

Operations of this automatic exposing and printing apparatus will be described next. First, the reel 1 on which long developed photographic film 10*b* is wound is set in place, and the forward end of the long film 10*b* or the leader 15 attached to the forward end is passed around the dancer 5 and inserted into the film transport device 40.

When the film sensor 81 detects the long film 10*b*, the pulse motor 41 is operated to rotate the first drive roller 42 to transport the long film 10*b*, and the solenoid of the discharge device 7 is operated to swing the guide 50*a* to the state shown in phantom lines in FIG. 2.

When, in this state, the end sensor 82 detects a joint in the long film 10*b*, the main cutter 60 is operated to cut off unwanted parts of the long film 10*b* such as the forward end and the leader 15. At this time, the forward end and the leader 15 of the long film 10*b* are guided by the guide 50*a* to extend downward. Thus, the unwanted, cut parts fall into the trash box 50. Subsequently, the guide 50*a* is returned to the state shown in solid lines in FIG. 2. The long film 10*b* with the forward end cut off advances through the slit formed in the guide 50*a* to the second drive roller 45. The second drive roller 45 advances the long film 10*b* further on to the forward end sensor 84.

When the forward end sensor 84 detects the forward end of the long film 10*b*, the DC motor 44 is stopped to stop the second drive roller 45. The loop guide 8*b* of the loop tank 8 is swung to the position shown in a phantom line in FIG. 2 to open the loop tank 8.

In this state, the first drive roller 42 continues rotating to transport the long film 10*b*. Consequently, as shown in FIG. 3, the long film 10*b* slacks downward to form a loop inside the loop storing space 8*a*. When the end sensor 82 detects a next joint, the first drive roller 42 is stopped rotating. Then, the auxiliary cutter 70 is operated to cut off opposite film portions laterally of the splicing tape 13 at the cutting lines "m" in FIG. 8B. After rotating the first drive roller 42 by a predetermined amount, the main cutter 60 is operated to cut the film at the cutting line "k" in FIG. 8A. This results in the photographic film 10*a* in one order cut with the corresponding splicing tape 13 remaining attached thereto. The bar code 14 printed on the splicing tape 13 is read by a bar cord reading sensor 87 disposed in a suitable position on the transport line, to be used in subsequent film processing.

The second drive roller 45 is rotated again to transport the photographic film 10*a* in this one order. When the rear end of this film 10*a* moves past the forward end sensor 84, the loop guide 8*b* is swung back to the position to close the loop tank 8.

The photographic film 10*a* in one order cut off the long film 10*b* has already been checked by the image frame distinguishing device 83 whether or not the film 10*a* is fit for processing by the exposing and printing unit 30. That is, it has been determined whether the image frames on this film 10*a* are full size or panorama size suited to the exposing and printing unit 30, or half size not suited thereto. If the frames are the sizes suited to the exposing and printing unit 30, the film 10*a* is transported to the image information reading unit 20 at the next stage. Necessary information is read and shown on the display 2. Subsequently, the exposing and printing unit 30 prints the image frames on the printing paper 9. At a point of time the rear end of the photographic film 10*a* passes the second rear end sensor 86, the first drive roller 42 is driven again to repeat the same operation.

When the image frames on the photographic film 10*a* are the size not suited to the exposing and printing unit 30, the solenoid 94 is operated to drive the line switching element 93. The line switching element 93 guides the film 10*a* into the through passage 91. The DC motor 95 is operated to rotate the fourth drive roller 96 to discharge the film 10*a* from the transport line. At a point of time the rear end of the film 10*a* passes the first rear end sensor 85, the first drive roller 42 is driven to repeat the same operation.

Other embodiments will be described hereinafter.

The foregoing embodiment includes the image information reading unit 20 and exposing and printing unit 30 as examples of exposure processing units. These exposure processing units include all processing units needed to expose and print the images of photographic film on printing paper.

Only the image frame distinguishing device 83 has been described as an example of film propriety distinguishing devices. In extreme cases of over-exposure or under-exposure, for example, film need not be transmitted to the image information reading unit 20 or exposing and printing unit 30. A device may be provided for distinguishing this type of film, and such a device also is included in the film propriety distinguishing devices.

Further, the transport line branching device 90 is shown as an example of process averting devices. Another example is a device for taking an appropriate measure to omit the exposing and printing process for photographic film 10 unsuited to the exposing and printing unit 30.

The image frame distinguishing device 83 may include notch sensors for detecting notches cut in lateral edges of photographic film 10, in place of the image frame sensors 83*a* and 83*b* described in the foregoing embodiment. That is, the image frame distinguishing device 83, based on detection signals from the notch sensors, may measure longitudinal dimensions of image frames in each order to determine whether the image frames are full size, panorama size or half size.

The foregoing embodiment includes the transport line branching device 90 acting exclusively as a process averting device. However, the discharge device 50 for removing unwanted parts of film from the transport line may be used also as the process averting device. That is, photographic film 10 determined by the image frame distinguishing device 83 to be unfit may be dropped into the trash box 50 by operating the guide 50*a*. In this case, the photographic film 10 and unwanted parts of the film may be sorted for collection.

In the foregoing embodiment, the discharge passage 51 includes the partition 52 formed of a single plate for deflecting the leader 15. The partition may have various shapes such as a bar shape, or a lattice shape for allowing passage of film fragments cut from regions adjacent the splicing tape 13.

Figure 11:
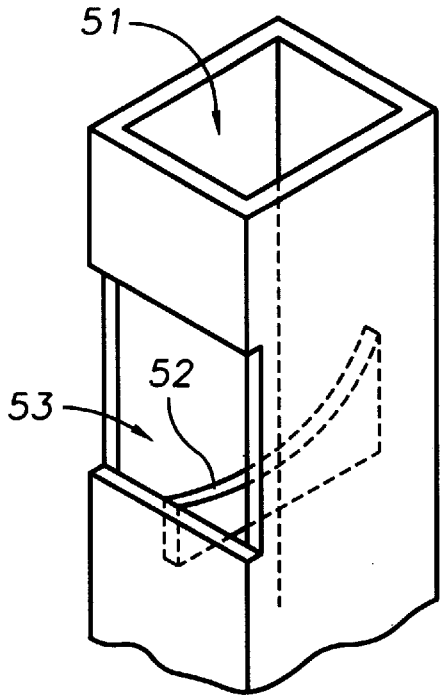
FIG. 11 is a persipective view of a modified example of a lower portion of a trash box.

In the foregoing embodiment, the opening 53 of the discharge passage 51 has a lower edge at equal height to the upper edge of the partition 52 at the end adjacent the opening 53. As shown in FIG. 11, the upper edge of the partition 52 at the end adjacent the opening 53 may be at a higher level than the lower edge of the opening 53 of the discharge passage 51. Then, the leader 15 may be discharged smoothly without the forward end thereof being caught by the lower edge of the opening 53.

Figure 12:
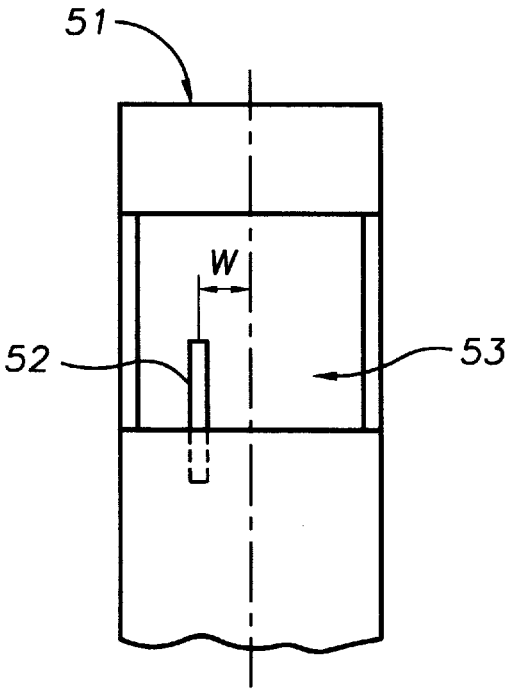
FIG. 12 is a front view of the modified example of the lower portion of the trash box.

In the foregoing embodiment, the partition 52 is mounted in vertical posture right under a transversely middle position of the film transport line (on the dot-and-dash line in FIG. 12). However, as shown in FIG. 12, the partition 52 may be displaced sideways by a distance W from the dot-and-dash line position. With this construction, when film fragments cut from regions adjacent the splicing tape 13 fall in horizontal posture and collide with the upper edge of the partition 52, the film fragments rest asymmetrically thereon. As a result, the film fragments quickly become tilted and fall down the discharge passage 51. That is, the film fragments cut from regions adjacent the splicing tape 13 fall smoothly past the partition 51.

What is claimed is:

1. A photographic film processing apparatus for processing a long developed film formed by joining photographic films with a splicing material, comprising:

first transport means for transporting said long developed film;

joint detecting means for detecting a region of said splicing material in said long developed film;

main cutter means for cutting said long developed film transported by said first transport means, in said region of said splicing material to form short films; and second transport means for transporting said short films to exposure processing means.

2. A photographic film processing apparatus as defined in claim 1, further comprising loop storing means disposed on a transport line formed by said first transport means and said second transport means for storing said long developed film in loop form.

3. A photographic film processing apparatus as defined in claim 1, further comprising discharge means interposed between said main cutter means and said exposure processing means for discharging film fragments cut by said main cutter means from a transport line formed by said first transport means and said second transport means.

4. A photographic film processing apparatus as defined in claim 1, further comprising film propriety distinguishing means disposed on a transport line formed by said first transport means and said second transport means for determining whether said short films are fit for processing by said exposure processing means.

5. A photographic film processing apparatus as defined in claim 4, wherein said film propriety distinguishing means has an image frame distinguishing function for detecting image frames on said long developed film based on quantities of light received after being transmitted through said long developed film, and determining lengths of said image frames on said long developed film.

6. A photographic film processing apparatus as defined in claim 4, further comprising process averting means for averting, from processing by said exposure processing means, those of said short films determined by said film propriety distinguishing means to be unfit.

7. A photographic film processing apparatus as defined in claim 6, wherein said process averting means defines a branch line for branching said short films determined to be unfit from said transport line.

8. A photographic film processing apparatus as defined in claim 3, wherein said discharge means defines a discharge passage extending downward from said transport line for guiding cut film fragments including small fragments from film regions adjacent said splicing material and a large fragment including a film leader connected to a forward end of said long developed film, said discharge passage including partition means mounted in an intermediate position thereof for allowing passage of only said small fragments and deflecting said large fragment.

9. A photographic film processing apparatus as defined in claim 8, wherein said partition means is disposed in such a position that said large fragment is transported by said transport line until a forward end of said film leader reaches said partition means.

10. A photographic film processing apparatus as defined in claim 8, wherein said discharge means includes a branching opening defined in a side wall of said discharge passage above said partition means for allowing passage of said large fragment.

11. A photographic film processing apparatus as defined in claim 8, wherein said discharge means includes a movable guide disposed in a region of intersection between said transport line and said discharge passage to be switchable between a posture for guiding said short films to advance along said transport line and a posture for guiding said film fragments cut by said main cutter means into said discharge passage.

12. A photographic film processing apparatus as defined in claim 1, further comprising auxiliary cutter means for cutting lateral portions of said region of said splicing material in said long developed film.

13. A photographic film processing apparatus as defined in claim 12, wherein said main cutter means is operable to cut said long developed film such that at least part of said splicing material remains attached to one of said short films downstream with respect to a direction of transport.

14. A photographic film processing apparatus as defined in claim 13, wherein said main cutter means is operable to cut said long developed film in a position upstream of said splicing material with respect to said direction of transport.

15. A photographic film processing apparatus as defined in claim 14, wherein said main cutter means is operable to cut said long developed film only in said position upstream of said splicing material whereby said splicing material remains intact on said downstream one of said short films.

16. A photographic film processing apparatus as defined in claim 14, wherein said auxiliary cutter means is operable to cut said region of said splicing material such that a width at a forward end of an upstream one of said short films is contained within a width of said downstream one of said short films.

17. A photographic film processing apparatus as defined in claim 12, wherein said main cutter means and said auxiliary cutter means are integrated.

18. A photographic film processing apparatus as defined in claim 12, wherein said main cutter means and said auxiliary cutter means are provided separately.

19. A photographic film processing apparatus as defined in claim 12, wherein said splicing material remaining attached to one of said short films includes data relating to said one of said short films.

20. A photographic film processing apparatus as defined in claim 19, further comprising reading means for reading said data from said splicing material and outputting contents of said data.

21. A photographic film processing apparatus as defined in claim 20, wherein said data is stored in a film identifying bar code printed on said splicing material.

* * * * *

UNITED STATES PATENT AND TRADEMARK OFFICE

CERTIFICATE OF CORRECTION

PATENT NO. : 6,056,451
DATED : May 2, 2000
INVENTOR(S) : Seki et al

It is certified that error appears in the above-identified patent and that said Letters Patent is hereby corrected as shown below:

On the cover page: Item [56]

entitled Attorney, Agent or Firm, change "Felfe & Lynch" to - - Fulbright & Jaworski LLP - -.

In column 8, line 34, change "and or" to - - and/or - -.

Signed and Sealed this

Ninth Day of January, 2001

*Attest:*

Q. TODD DICKINSON

*Attesting Officer*

*Commissioner of Patents and Trademarks*

UNITED STATES PATENT AND TRADEMARK OFFICE

CERTIFICATE OF CORRECTION

PATENT NO. : 6,056,451

DATED : May 2, 2000

INVENTOR(S) : Seki, et. al.

It is certified that error appears in the above-indentified patent and that said Letters Patent is hereby corrected as shown below:

Title page, item [30], Foreign Application Priority Data, change "Aug." to --Feb.--

Title page, under Attorney, Agent, or Firm, change "Felfe & Lynche" to --Fulbright & Jaworski L.L.P.--

Column 8, line 34, change "and or" to --and/or--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*